United States Patent [19]

Polk et al.

[11] 4,116,682

[45] Sep. 26, 1978

[54] AMORPHOUS METAL ALLOYS AND PRODUCTS THEREOF

[76] Inventors: Donald E. Polk, 2 Rollins Pl., Boston, Mass. 02114; Bill C. Giessen, 22 Centre St., Cambridge, Mass. 02139

[21] Appl. No.: 754,537

[22] Filed: Dec. 27, 1976

[51] Int. Cl.[2] ..... C22C 19/02; C22C 19/07; C22C 22/00; C22C 27/06; C22C 37/00; C22C 38/00

[52] U.S. Cl. ..... 75/123 H; 75/122; 75/123 A; 75/123 D; 75/123 J; 75/123 K; 75/123 L; 75/123 M; 75/123 N; 75/134 F; 75/134 M; 75/170; 75/176

[58] Field of Search ..... 75/126, 128, 122, 170, 75/171, 176, 134 M, 134 F, 123 B, 123 E, 123 A, 123 D, 123 H, 123 J, 123 K, 123 N, 123 L, 123 M

[56] References Cited

U.S. PATENT DOCUMENTS

| | | | |
|---|---|---|---|
| 3,856,513 | 12/1974 | Chen et al. | 75/122 |
| 3,871,836 | 3/1975 | Polk et al. | 29/194 |
| 3,986,867 | 10/1976 | Masumoto et al. | 75/126 A |

OTHER PUBLICATIONS

Business Week, 12/1/73, "New Metals in Search of a Use," pp. 64j–65.

*Primary Examiner*—Arthur J. Steiner
*Attorney, Agent, or Firm*—Morse, Altman, Oates & Bello

[57] ABSTRACT

A class of amorphous metal alloys is provided in which the alloys are rich in iron, nickel, cobalt, chromium and/or manganese. These alloys contain at least one element from each of three groups of elements and are low in metalloids compared to previously known liquid quenched amorphous alloys rich in iron, nickel, cobalt, chromium and/or manganese. The alloys can be readily formed in the amorphous state and are characterized by high hardness, high elastic limit and, for selected compositions, good corrosion resistance. Products made from these alloys include cutting tools, such as razor blades.

8 Claims, No Drawings

AMORPHOUS METAL ALLOYS AND PRODUCTS THEREOF

BACKGROUND OF THE INVENTION

1. Field of the Invention

This invention relates generally to amorphous metal alloys and products thereof and more particularly is directed towards a novel class of amorphous metal alloys rich in iron, nickel, cobalt, chromium and/or manganese and low in metalloids.

2. Description of the Prior Art

A solid amorphous metal is one in which the constituent atoms are arranged in a spatial pattern that exhibits no long range order, that is, it is non-crystalline. This lack of long range order is also a characteristic of liquids, but amorphous solids are distinguished from liquids by their high rigidity, which is comparable to that of crystalline bodies. Some metallic alloys, if cooled rapidly, can be formed into amorphous solids. Amorphous solids of this type are sometimes known as glassy metals. Solid amorphous metals may be obtained from certain alloy compositions, and an amorphous substance generally characterizes a non-crystalline or glassy substance. In distinguishing an amorphous substance from a crystalline substance, X-ray diffraction measurements are generally employed.

Heretofore, a limited number of amorphous metal alloys have been prepared. An alloy can be produced in the amorphous state by rapidly quenching a molten alloy of a suitable composition or, alternatively, by a deposition technique or other suitable means. Suitably employed vapor deposition, sputtering, electro-deposition or chemical deposition can be used to produce the amorphous metal.

Previously, amorphous metals quenched from melts which have been rich in iron, nickel, cobalt, chromium and/or manganese have generally either contained about 15 to 25 atomic percent of a metalloid (e.g. phosphorus, boron, carbon, silicon, etc.), generally referred to as transition metal-metalloid (TM-M) alloys, or more than about 30 percent of early transition metals (e.g. niobium or tantalum), generally referred to as inter-transition metal (TM-TM) alloys.

It is an object of the present invention to provide a novel class of alloys and products made therefrom in which the alloys are rich in iron, nickel, cobalt, chromium and/or manganese and low in metalloids compared to previously known liquid-quenched amorphous alloys rich in iron, nickel, cobalt, chromium and/or manganese.

SUMMARY OF THE INVENTION

This invention features a class of amorphous metal compositions which are readily quenched to the amorphous state in which they display improved physical characteristics, the class of compositions being defined by the formula $M_aT_bX_c$ where M is any combination of elements from the group consisting of iron, nickel, cobalt, chromium and manganese; T is any combination of elements from the group consisting of zirconium, tantalum, niobium, molybdenum, tungsten, yttrium, titanium and vanadium; and X is any combination of elements in the group consisting of boron, silicon, phosphorus, carbon, germanium and arsenic where a ranges from 60 to 87 atomic percent; *b* ranges from 3 to 30 atomic percent; and *c* ranges from 1 to 10 atomic percent.

DETAILED DESCRIPTION OF THE PREFERRED EMBODIMENTS

The novel compositions of this invention can be made into amorphous metals by various quenching techniques to produce amorphous metal alloys displaying characteristics useful in production of products such as razor blades, high strength fibers, and other products where high hardness, high strength and corrosion resistance are desirable and in the production of products where soft magnetic properties are desirable. The group of alloys which is the subject of this invention is defined by the general formula $M_aT_bX_c$ where M is any combination of elements of the group consisting of iron, nickel, cobalt, chromium and manganese; T is any combination of elements in the group consisting of zirconium, tantalum, niobium, molybdenum, tungsten, yttrium, titanium and vanadium; an X is any combination of elements from the group consisting of boron, silicon, phosphorus, carbon, germanium and arsenic where a ranges from 60 to 87 (preferably 70 to 85) atomic percent; *b* ranges from 3 to 30 (preferably 6 to 20) atomic percent; and *c* ranges from 1 to 10 (preferably 5 to 10) atomic percent. The subscripts a, b and c represent atomic percent and, therefore, $a + b + c = 100$ in any one case.

The alloys of interest are rich in iron, nickel, cobalt, chromium and/or manganese. These five metals make up from 60 to 87 atomic percent of the preferred alloys. The generalized composition of the alloys describes a compositional range which includes alloys which can be formed readily in the amorphous state, i.e., such amorphous alloys can be formed by rapid quenching of the corresponding melt.

Previously, amorphous metals prepared by quenching of the melt which have contained > 70 at % of Fe, Ni, Co, Cr and/or Mn have generally contained about 15 to 25 atomic percent of a metalloid, e.g. phosphorus, boron, carbon or silicon. Examples of such alloys are $Fe_{75}P_{15}C_{10}$, $Fe_{80}B_{20}$ and $Fe_{40}Ni_{40}P_{14}B_6$. These alloys generally are referred to as transition metal-metalloid (TM-M) alloys. Examples of another type of related amorphous alloys prepared from the liquid are $Ni_{60}Nb_{40}$ and $Ni_{50}Ta_{50}$; for this type of alloy, the early transition metal (i.e. niobium or tantalum for these examples) is present with compositions greater than about 35 atomic percent. These alloys are generally referred to as inter-transition metal (TM-TM) alloys.

The class of alloys of this invention is unique in that the class includes, for example, alloys containing 85 atomic percent iron but less than 10 atomic percent metalloid. Further, alloys of this class such as $Fe_{84}Zr_8B_8$ cannot be obtained by mixing compositions typical of previously known TM-M and TM-TM amorphous alloys.

The alloys of interest in the following examples were prepared by melting together the properly proportioned elements. The metal was prepared in the amorphous state, i.e. as a metallic glass, by being rapidly quenched from the liquid. Quenching was accomplished using a process similar to either the arc-melting piston-and-anvil technique as described by M. Ohring and A. Haldipur, Rev. Sci. Instrum. 42, 530 (1971) or the melt spinning technique as described by R. Pond and R. Maddin, Trans. Met. Soc. AIME 245, 2475 (1969). Alloys were judged to be amorphous on the basis of X-ray diffraction patterns.

EXAMPLE I

The alloy $Fe_{84}Zr_8B_8$ was prepared from the proper elements which were first melted and then quenched to the amorphous state using the arc-melting piston-and-anvil technique. Using X-ray diffraction techniques, the solid metal alloy was established to be amorphous.

EXAMPLE II

The alloy $Ni_{40}Fe_{23}Cr_{13}Ti_{16}B_8$ was prepared by mixing together the appropriate constituents and melting them to a liquid form. The liquid was then rapidly quenched to the amorphous state using the arc-melting piston-and-anvil technique.

EXAMPLE III

The alloy $Ni_{36}Co_{28}Cr_{12}Ti_{16}B_8$ was prepared and quenched in accordance with the procedures of Example I and produced a solid amorphous metal alloy useful as razor blade material.

EXAMPLE IV

The alloy $Fe_{76}Ti_{16}B_8$ was prepared and quenched following the procedures set forth in Example I and the resulting solid alloy proved to be in the amorphous state.

EXAMPLE V

The alloy $Ni_{39}Co_{32}Cr_{12}Zr_8B_6Si_3$ may be prepared, melted and quenched following the procedures in Example I and result in an amorphous metal alloy.

EXAMPLE VI

The alloy $Ni_{38}Co_{30}Cr_{12}Zr_8Ta_4P_8$ may be prepared, melted and quenched following the procedures in Example I and result in an amorphous metal alloy.

EXAMPLE VII

In this example a ribbon of an amorphous metal alloy was formed by melt spinning techniques from a composition of $Ni_{38}Co_{30}Cr_{12}Zr_8W_4B_8$. The amorphous ribbon formed in this example was approximately 30$\mu$m thick, displayed a very high hardness (DPH = 943 Kg/mm$^2$) and had in addition a high elastic limit and excellent corrosion resistance. The excellent corrosion resistance was attributed in part to compositional homogeneity and the lack of grain boundaries. The amorphous alloy in ribbon form provides superior razor blade material and may have one or more edges sharpened.

EXAMPLE VIII

An amorphous ribbon was formed by the melt-spinning techniques, as set forth in Example VII, from an alloy composition $Fe_{84}Zr_8B_8$. The amorphous ribbon alloy produced by this example displayed good bending ductility and high hardness.

While many amorphous metals have been available heretofore, the group of alloys of this invention is compositionally distinct from those previously reported. Previous amorphous metals containing high concentrations of the M elements can be described as falling into two categories: (1) those in which M was alloyed primarily with elements such as those labelled T (above) or rare earths, where these added elements typically comprised 30 to 60 atomic percent (e.g., $Ni_{60}Nb_{40}$); and (2) those in which M was alloyed primarily with elements such as those labelled X above, where these added elements typically comprised 15 to 25 atomic percent (e.g., $Fe_{75}P_{15}C_{10}$ and $Ni_{50}Fe_{30}P_{14}B_6$). While various amounts of X elements may have been added to previous alloys of Type (1) or various amounts of elements T may have been added to previous alloys of Type (2), the amounts of elements T and X were not adjusted simultaneously to produce amorphous metals where both the T and X elements were present in amounts as low as those obtained in the present case, e.g., $M_{84}Zr_8B_8$. Such alloys as a group are distinct from previous alloys. It is noted that an alloy such as $M_{84}Zr_8B_8$ cannot be produced by mixing amorphous metals of the compositional types previously produced from the melt.

It is also noted that the addition of small amounts of certain other elements (e.g., aluminum) to the compositions described above does not produce significantly different alloys.

These amorphous (non-crystalline) metallic alloys are produced by a rapid quenching of the corresponding liquid at rates on the order of $10^{5°}$ C/sec. so as to retain the metastable amorphous solids.

Any preparation technique which imposes a sufficiently high cooling rate upon the liquid can be used to produce these materials. Typically, the high quench rate is achieved by spreading the liquid metal as a thin layer on a colder substrate of high thermal conductivity such as copper. The thermal conductivity of the liquid being cooled and of potential substrates (or fluid quench media) require that at least one dimension of the quenched material be small so as to achieve the required cooling rate via conductance of the heat from the liquid metal. Another example of processes which can be used to produce such quench rates is described by Chen and Miller, Rev. Sci. Instrum. 41, 1237 (1970). Such processes are generally used to produce ribbon shaped material having thicknesses on the order of 0.0005 to 0.0050 inch.

Such materials have potential commercial applications dependent on their mechanical and magnetic properties. These materials are relatively strong and hard; they display tensile strengths on the order of 300,000 to 500,000 psi; diamond pyramid hardnesses on the order of 700 to 1,100 Kg/mm$^2$ are obtained.

Such properties make filaments of these alloys suitable for use as high strength fibers. In addition, the good corrosion resistance of selected compositions within the more general range described above, combined with their very high elastic limit and the ductility evidenced in their ability to sustain a permanent deformation upon severe bending, make these materials desirable for use as razor blades. Further, some of these alloys, e.g., iron rich alloys, are soft ferromagnets which may find applications where high permeability and low loss ferromagnetic metal is required as, for example, those applications now employing Permalloy.

Having thus described the invention, what we claim and desire by Letters Patent of the United States is:

1. An amorphous metal alloy of the formula $M_aT_bX_c$ which is substantially amorphous when rapidly cooled to the solid state wherein M is at least one element selected from the group consisting of Fe, Co, Ni, Cr and Mn and mixtures thereof, T is at least one element selected from the group consisting of Zr, Ta, Nb, Mo, W, Y, Ti and V and mixtures thereof, and X is at least one element selected from the group consisting of B, Si, P, C, Ge and As and mixtures thereof, wherein *a*, *b* and *c* are atomic percentages ranging from about 60 to 87, 3 to 30, and 1 to 10, respectively, said *a*, *b* and *c* totalling 100 in any one alloy.

2. An amorphous metal alloy, according to claim 1, wherein *a, b,* and *c* range from 70–85, 6 to 20, and 5 to 10, respectively.

3. As an article of manufacture, sheets, ribbons and fibers of the amorphous metals having the composition of claim 1.

4. As an article of manufacture, sheets, ribbons and fibers of the amorphous metals having the composition of claim 2.

5. A cutting implement formed from a metal which is substantially amorphous, said metal having the composition $M_aT_bX_c$ wherein M is at least one element selected from the group consisting of Fe, Co, Ni, Cr and Mn and mixtures thereof, T is at least one element selected from the group consisting of Zr, Ta, Nb, Mo, W, Y, Ti and V and mixtures thereof, and X is at least one element selected from the group consisting of B, Si, P, C, Ge and As and mixtures thereof, wherein *a, b* and *c* are atomic percentages ranging from about 60 to 87, 3 to 30, and 1 to 10, respectively, said *a, b* and *c* totalling 100 in any one composition.

6. A cutting implement, according to claim 5, wherein *a, b* and *c* range from 70 to 85, 6 to 20, and 5 to 10, respectively.

7. An amorphous metal alloy, according to claim 1, wherein *b* and *c* added together range from 13–40 in any one alloy.

8. A cutting implement, according to claim 5, wherein *b* and *c* added together range from 13–40 in any one composition.

* * * * *